US006523906B1

(12) United States Patent
Holder

(10) Patent No.: US 6,523,906 B1
(45) Date of Patent: Feb. 25, 2003

(54) FLOOR COVERING REMOVAL APPARATUS

(76) Inventor: Tommie J. Holder, P.O. Box 275, Mountain Park, OK (US) 73559-0275

( * ) Notice: Subject to any disclaimer, the term of this patent is extended or adjusted under 35 U.S.C. 154(b) by 122 days.

(21) Appl. No.: 09/716,988

(22) Filed: Nov. 20, 2000

Related U.S. Application Data

(60) Provisional application No. 60/166,417, filed on Nov. 19, 1999.

(51) Int. Cl.[7] ..... B32B 31/18; E01C 23/088; A47L 13/02

(52) U.S. Cl. ..... 299/36.1; 299/41.1; 125/13.03; 451/70; 15/93.1; 30/170

(58) Field of Search ..... 299/36.1, 37.1, 299/39.1, 39.4, 39.5, 41.1; 125/13.03; 451/69, 70, 350–353, 347; 15/93.1, 87, 78, 49.1, 98; 81/45; 30/169, 170; 56/15.9, 16.2, 6, 7, 228

(56) References Cited

U.S. PATENT DOCUMENTS

| | | | | |
|---|---|---|---|---|
| 1,442,544 A | | 1/1923 | Schwenke | |
| 1,883,404 A | * | 10/1932 | Ronning | 299/39.4 X |
| 2,864,104 A | | 12/1958 | Le Sage | |
| 2,913,855 A | | 11/1959 | Vinella | |
| 3,007,687 A | | 1/1961 | Hatcher | |
| 2,973,536 A | | 3/1961 | Doyle | |
| 3,098,329 A | | 7/1963 | Doran | |
| 3,347,596 A | | 10/1967 | Brejcha et al. | |
| 3,539,014 A | * | 11/1970 | Jonsson | 172/111 |
| 4,099,328 A | | 7/1978 | Schlemmer | |
| 4,172,615 A | | 10/1979 | Hakes | |
| 4,251,896 A | | 2/1981 | Block | |
| 4,486,931 A | | 12/1984 | Pichelman et al. | |
| 4,523,361 A | | 6/1985 | Dummermuth | |
| 4,592,108 A | | 6/1986 | Svendsen | |
| 4,614,380 A | | 9/1986 | Allen | |
| 4,756,578 A | | 7/1988 | Mims et al. | |
| 4,848,845 A | | 7/1989 | Kennedy | |
| 5,081,734 A | | 1/1992 | Sandford et al. | |
| 5,082,330 A | | 1/1992 | Holder | |
| 5,184,429 A | | 2/1993 | Parsons | |
| 5,197,784 A | * | 3/1993 | Holder | |
| 5,409,299 A | * | 4/1995 | Holder | |
| 5,882,086 A | * | 3/1999 | Bremner et al. | 299/41.1 |

FOREIGN PATENT DOCUMENTS

| | | |
|---|---|---|
| EP | 189617 A2 | 12/1985 |
| EP | 284391 A1 | 3/1988 |
| EP | 284391 B1 | 5/1991 |
| EP | 189617 B1 | 10/1991 |
| GB | 2033214 | 8/1978 |

* cited by examiner

*Primary Examiner*—David Bagnell
*Assistant Examiner*—Sunil Singh
(74) *Attorney, Agent, or Firm*—Dunlap, Codding & Rogers, P.C.

(57) ABSTRACT

A mobile apparatus for removing floor coverings. The apparatus has a main frame supported by wheels and includes a scraper blade mounted on the front of the frame and a rotary cutter assembly mounted underneath the frame with controls whereby the scraping blade is used independently of the rotary cutters and the rotary cutters are use independently of the scraping blade, and wherein the rotary cutters may be moved from underneath the frame to one side of the frame for ready access to the cutter members of the rotary cutters.

11 Claims, 16 Drawing Sheets

FLOOR COVERING REMOVAL APPARATUS

RELATED REFERENCES

This application claims the benefit of U.S. Provisional Application Serial No. 60/166,417 filed Nov. 19, 1999.

FIELD OF THE INVENTION

The present invention relates generally to the field of floor treatment devices, and more particularly, but not by way of limitation, to a floor treatment apparatus having a scraping assembly and a number of rotating cutter assemblies that are used cooperatively to remove floor covering from a floor and to plane a floor surface.

BRIEF DESCRIPTION OF THE DRAWINGS

FIG. 8 is a detailed partial cross-sectional view showing a portion of the structure shown in FIG. 7.

DETAILED DESCRIPTION OF THE INVENTION

Figures 1, 1A:
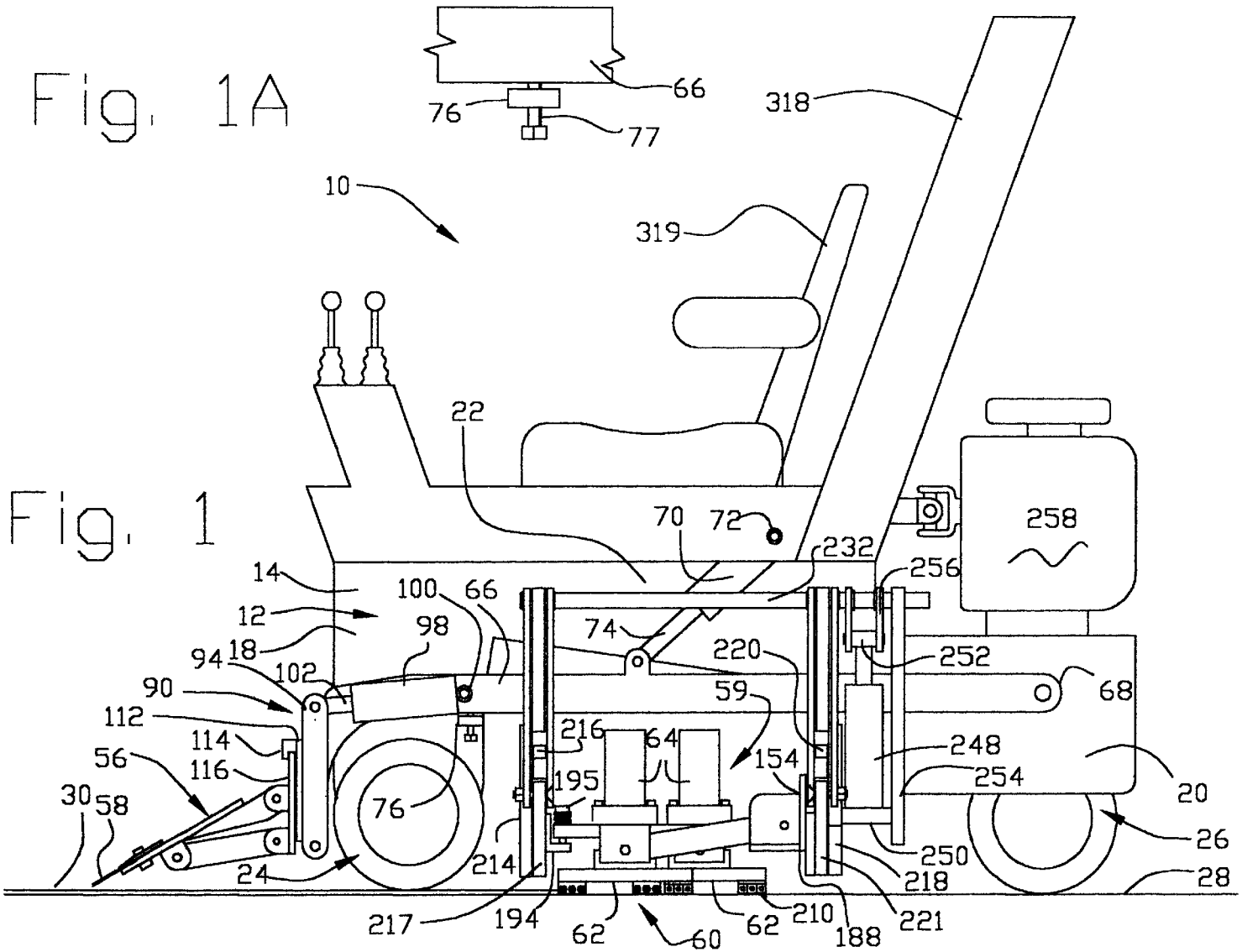
FIG. 1 is elevational view looking at the left side of the apparatus.
FIG. 1A is an enlarged drawing of an adjustable stop.

Turning to the drawings as a whole, and more particularly to FIGS. 1–4, shown therein is a left side view, a right side view, a front view and a rear view, respectively, of a floor treatment apparatus that is constructed in accordance with the present invention and generally denoted by the reference numeral 10. The floor treatment apparatus 10 has a central frame 12 having a first side 14 (see FIG. 1) and a second side 16 (see FIG. 2), the first and second sides 14, 16 extending longitudinally from a front end portion 18 of the central frame 12 to a rear end portion 20 of the central frame 12 with a medial portion 22 of the central frame 12 interposed therebetween.

A pair of motorized wheel assemblies 24 support the front end portion 18 of the central frame 12 and a motorized wheel assembly 26 supports the rear end portion 20 of the central frame 12, for a rolling support of the central frame 12 upon a floor surface 28 that may be covered with a floor covering 30. One purpose of the floor treatment apparatus 10 of the present invention is to remove the floor covering 30 that is typically adhered to the floor surface 28.

Figure 3:
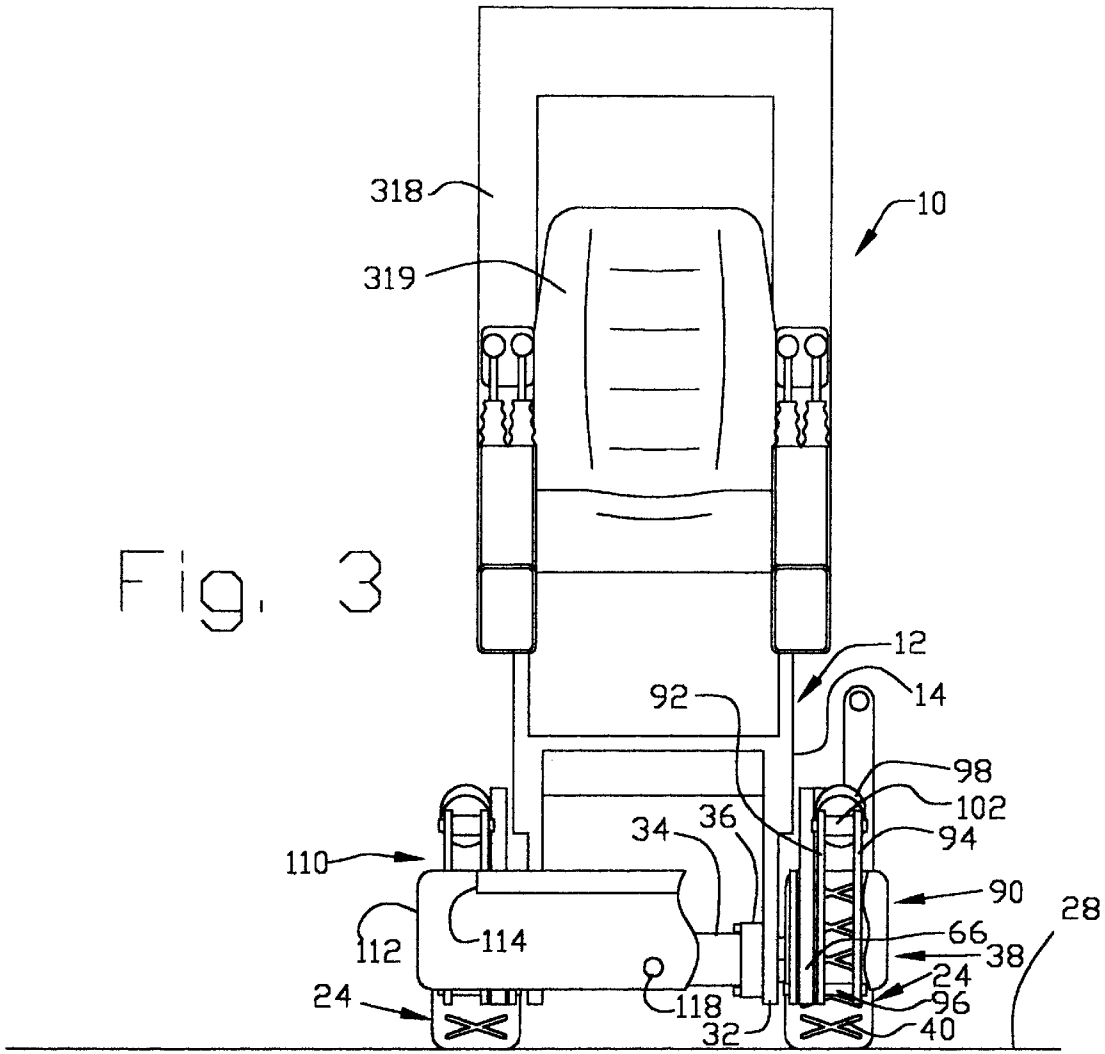
FIG. 3 is an elevation view looking at the front end of the apparatus with portions of the structure removed and portions broken away to illustrate details of construction.

FIG. 3 is partially cut away to illustrate the manner in which the motorized wheel assemblies 24 are supported by the central frame 12. On the first side 14 of the central frame 12 the motorized wheel assembly 24 is supported by an extending flange member 32 of the front end portion 18 of the central frame 12. A motor 34 has a mounting base 36 attached to the flange member 32, and an extending shaft (not shown) passes through the flange member 32 and drivingly engages a wheel 38 having a tire 40 trained thereabout for grippingly engaging the floor surface 28. Given the attachment of the motor 34 to the flange member 32 which is fixed relative to the central frame 12, the tire 40 of the motorized wheel assembly 24 rotates about an axis of rotation that is at all times substantially orthogonal to the first side 14 of the central frame 12. The motor 34 as described below is a hydraulic motor, but alternatively an electric motor could be used.

Figure 4:
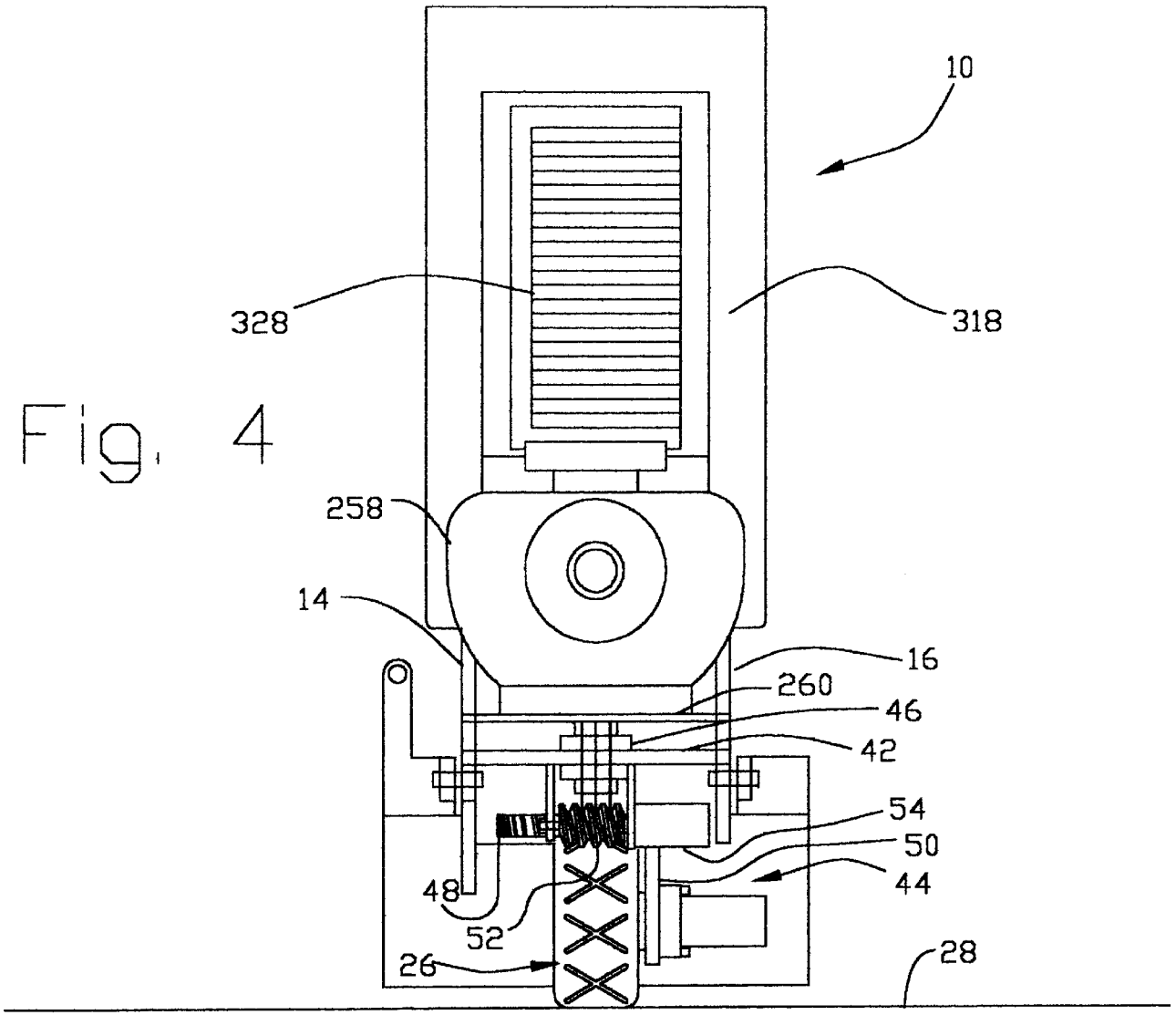
FIG. 4 is an elevational view looking at the rear end of the apparatus.

While the wheel assemblies 24 are fixed, FIG. 4 shows a motorized wheel assembly 26 is supported by the rear end portion 20 of the central frame 12 so as to be rotationally positionable relative to the central frame 12 in order to selectively steer the central frame 12. From FIG. 4 it will be noted the first side 14 and the second side 16 of the central frame 12 are joined in part by a cross member 42. A steering mechanism 44 and the wheel assembly 26 are supported by the cross member 42. The steering mechanism 44 includes a bearing 46 attached to the cross member 42 and which supports, in turn, a sprocket 48 in journalled engagement with the cross member 42. A bracket 50 is attached to the sprocket 48 and is thereby rotationally positionable in response to rotation of the sprocket 48. The motorized wheel assembly 26 is supported by the bracket 50 in the same manner that the motorized wheel assembly 24 is supported by the flange member 32 as described above. However, the bracket 50 is not fixed relative to the central frame 12, unlike the flange member 32. A worm gear 52 and a steering motor 54 are supported by the cross member 42 and threadingly engage the sprocket 48 to rotationally position the sprocket 48 so as to turn the motorized wheel assembly 26 relative to the central frame 12 to steer the floor treatment apparatus 10. It will be noted that alternative constructions for the steering mechanism 44 will be recognized as alternative design choices, such as, but not limited to, the use of a rotary actuator to rotationally position the motorized wheel assembly 26.

Figure 2:
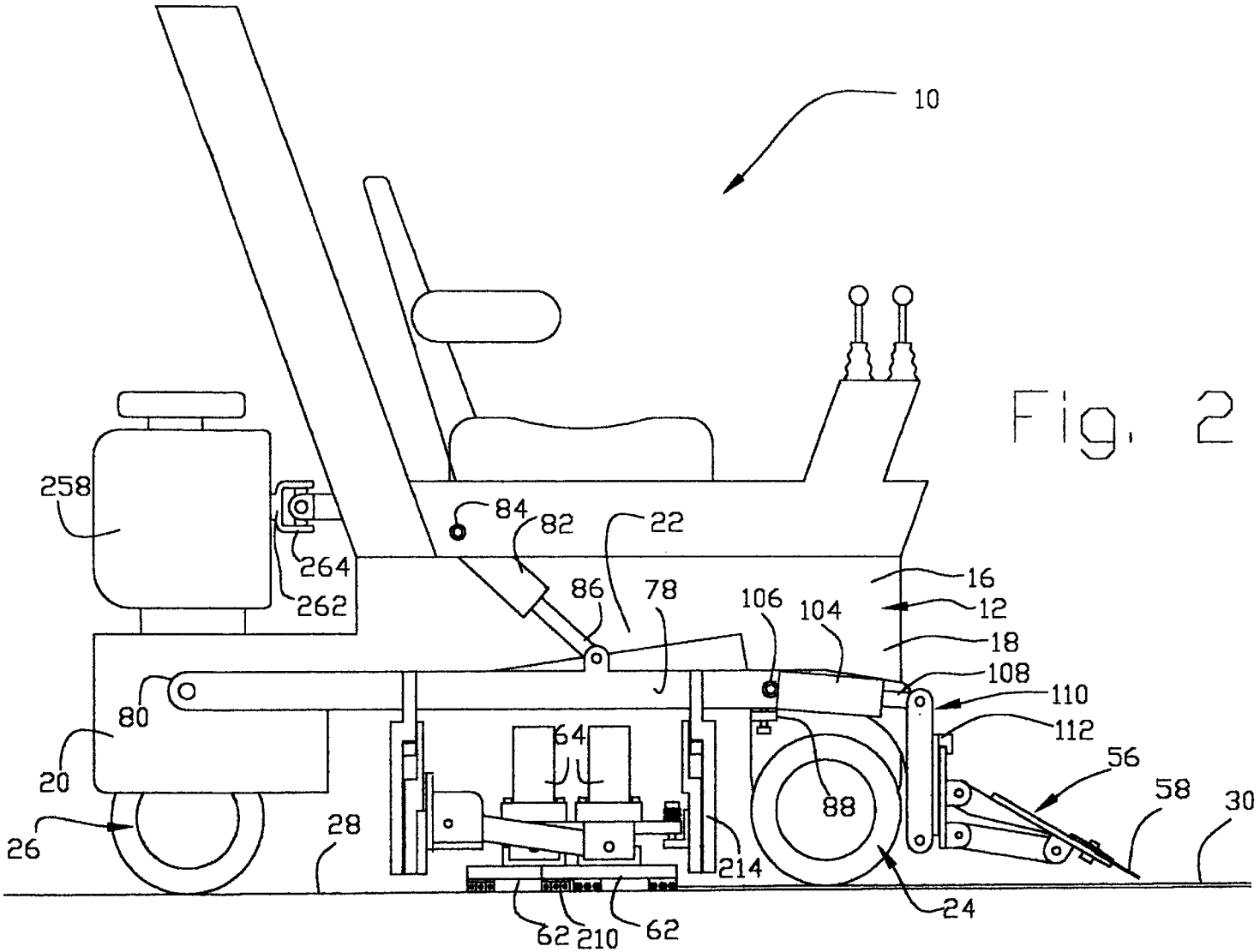
FIG. 2 is an elevational view looking at the right side of the apparatus.

As will become clear from the following description, the floor treatment apparatus 10 supports devices that are effective in removing the floor covering 30 from the floor surface 28. FIGS. 1 and 2 show a scraping tool assembly 56 attached to the floor treatment apparatus 10, providing a scraper blade 58 for scrapingly engaging the floor covering 30 as the central frame 12 is propelled forward by the motorized wheel assemblies 24, 26. Additionally, a rotary cutter assembly 60 is attached to the floor treatment apparatus 10, providing a plurality of rotary cutters 62 beneath the medial portion 22 of the central frame 12 which are each rotated by a motor 64 to cut away the floor covering 30. As will be seen below, the rotary cutter assembly 60 can also be used to plane the floor surface 28.

In removing floor covering such as tile, carpeting or the like, use of the scraping tool assembly 56 is preferred as it is the more economical method of the two alternatives. Firstly, use of the scraping tool assembly 56 permits a significantly greater forward velocity of the floor treatment apparatus 10 so that less time is necessary to remove a given area of floor covering 30. Also, the tooling cost of the scraping tool assembly 56 is significantly lower than that of the rotary cutter assembly 60.

At times, however, the scraping tool assembly 56 is inadequate in removing the floor covering 30, and the more rigorous engagement action of the rotary cutter assembly 60 is necessary. A novel advantage of the present invention is the ability to automatically switch back and forth between the two methods.

As mentioned, the rotary cutter assembly 60 can also be employed to plane the floor surface 28 in order to provide a level surface, or to dress a worn or weathered surface. In leveling the floor surface 28, floor leveling compound is commonly used to fill low spots and the rotary cutters 62 cut away the excess floor leveling compound, leaving in place that compound which lays below the desired floor surface plane. In planing some hard-surface floors, such as concrete floors, the cutters 62 of the rotary cutter assembly 60 can be equipped with an appropriate cutting device, such as a diamond cutter wheel, to cut away high spots in the floor surface 28.

Turning first to the manner in which the floor treatment apparatus 10 supports the scraping tool assembly 56, FIG. 1 shows a first lift arm 66 that is attached at one end thereof to a pivot 68 which is supported by the rear end portion 20 of the central frame 12. A lift cylinder 70 has a base 72 pivotally attached to the medial portion 22 of the central frame 12 and an opposing extensible shaft 74 attached to a medial portion of the first lift arm 66 so that retraction of the extensible shaft 74 pivots the first lift arm 66 upwardly, and extension of the extensible shaft 74 lowers the first lift arm 66. A positive stop member 76 is attached to a front end portion 18 of the central frame 12 so as to jut outwardly and impede the downward movement of the first lift arm 66 beyond a desired downward position. The positive stop member 76 has a threadably adjustable stop member 77 which can be advanced to adjustably determine the downward extent of travel of the first lift arm 66 (see FIG. 1A).

In the same manner, FIG. 2 shows an opposing second lift arm 78 that is attached at one end thereof to a pivot 80 which is supported by the rear end portion 20 of the central frame 12. A lift Cylinder 82 has a base 84 that is pivotally attached to the medial portion 22 of the central frame 12 and an opposing extensible shaft 86 that is attached to a medial portion of the second lift arm 78 so that a retraction of the extensible shaft 86 pivots the second lift arm 78 upwardly, and an extension of the extensible shaft 86 lowers the second lift arm 78. A positive stop member 88 is attached to a front end portion 18 of the central frame 12 so as to jut outwardly and impede the downward movement of the second lift arm 78 beyond a desired downward position.

FIGS. 1–3 show a yoke 90 having a link arm 92 and an opposing link arm 94 that pivot about a shaft 96 extending from a portion of the first lift arm 66. A cylinder 98 has a base 100 that is pivotably attached to the first lift arm 66 and an opposing extensible shaft 102 that is attached to the link arms 92, 94 of the yoke 90 such that an extension or a retraction of the shaft 102 affects a pivotal movement of the yoke 90 relative to the supporting portion of the first lift arm 66 whereat the shaft 96 depends. FIG. 2 illustrates how on the second side 16 of the central frame 12 in the same manner a cylinder 104 has a base 106 that is pivotally attached to the second lift arm 78 and an opposing extensible shaft 108 attached to a yoke 110 that pivots about a shaft (not shown) depending from a supporting position of the second lift arm 78 in the same manner previously described. An extension or a retraction of the cylinder 104 therefore affects a pivotal movement of the yoke 110 relative to the supporting portion of the second lift arm 78.

A tool mounting plate 112 is attached to the opposing yokes 90, 110 and is movable therewith to desired positions between a substantially vertical position corresponding to a retracted position of the cylinders 98, 104, as shown in FIGS. 1–3, and a tilted-forward position corresponding to an extension of the cylinders 98, 104 as discussed below. A number of well-known utility tools can be attached to the tool mounting plate 112 for operative use. These include, but are not limited to, barrel handlers, jack hammers, concrete saws, etc.

Figure 5:
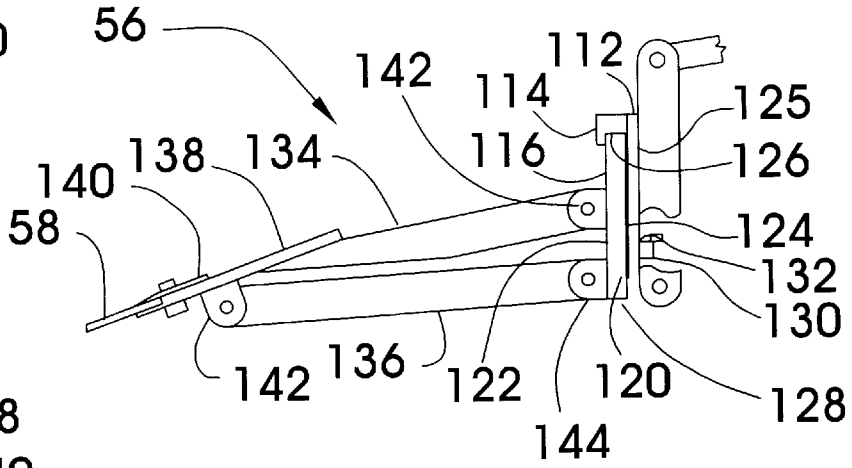
FIG. 5 is a side view of the scraper blade and the support for the scrapper blade.
Figure 6:
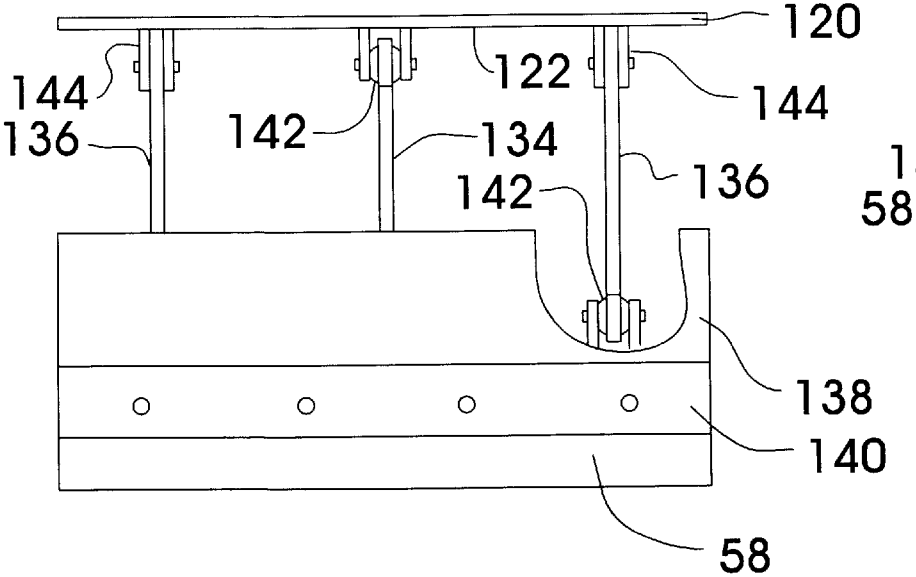
FIG. 6 is a top view of the scraper blade and the supporting structure, with a portion broken away to illustrate details of construction.

FIGS. 5 and 6 are detailed views that illustrates the scraping tool assembly 56 supported by the tool mounting plate 112 in a manner providing a quick-change attachment. The scraping tool assembly 56 has a base plate 120 with a front side 122, a rear side 124, an upper end 126, and a lower end 128. The tool mounting plate 112 supports a flange member 114 that forms a channel for a receiving engagement of the upper end 126 of the base plate 120. The base plate 120 furthermore has an opening 118 (FIG. 3). A tab 130 (FIG. 5) extends through the opening 118 and beyond the rear side 124 of the base plate 120, the tab 130 having an appropriate feature such as an aperture to receive a locking member such as a cotter pin or a locking ring 132 as shown. In this manner, it will be understood that the base plate 120 can be readily installed on the tool mounting plate 112 by a substantially upward movement of the base plate 120 into receiving engagement with the channel 116, and disposition of the tab 130 through the opening 118 so as to extend a portion thereof beyond the rear side 125 of the tool mounting plate 112 such that the locking member 132 can be attached to the tab 130.

The scraping tool assembly 56 furthermore has an upper extension member 134 and a pair of lower extension members 136 extending from the front side 122 of the base plate 120 and supporting, in turn, a blade holder plate 138. A clamping fastener 140 is pressingly engaged against the blade holder plate 138 with a portion of the scraper blade 58 compressingly engaged between the blade holder plate 138 and the clamping fastener 140 and thereby operatively retained.

The upper extension member 134 is attached at a first end to a ball joint 142 supported by the front side 122 of the base plate 120, and is pivotally attached at an opposing end to the blade holder plate 138. The lower extension members 136 are pinned at one end to a clevis 144 supported by the front side 122 of the base plate 120, and are each attached to a ball joint 142 attached to the blade holder plate 138. The ball joints 142 permit the blade holder plate 138 to roll with either end going up while the other end goes down in response to uneven floor conditions or to unexpected shifting of the central frame 12, such as occurs when one of the wheel assemblies 24 rolls over debris. In either case, the freedom of movement of the scraper blade 58 permits a continuous engagement of the scraper blade 58 against the floor surface 28.

Figures 5, 7:
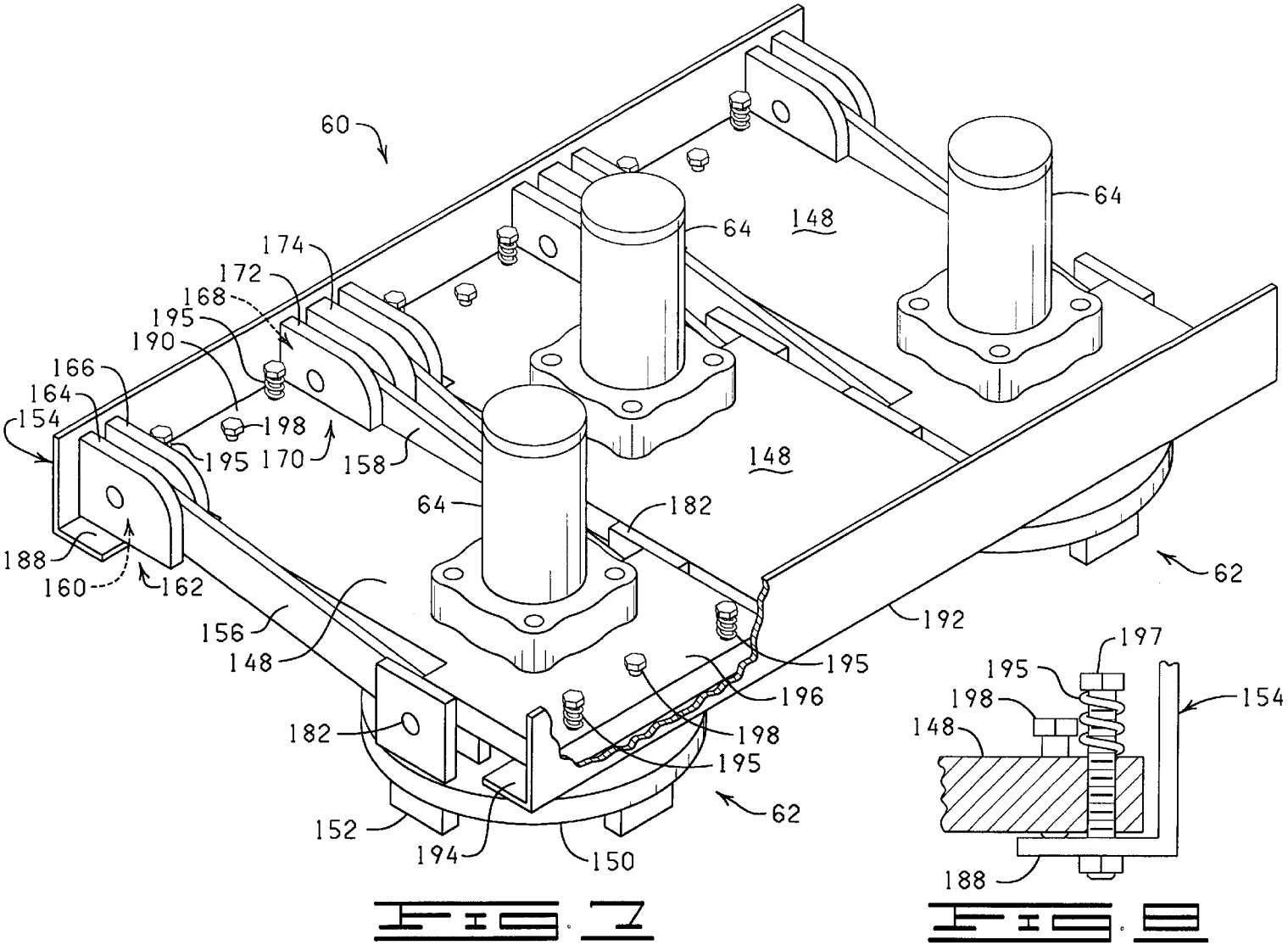
FIG. 7 is a prospective view showing the supports for the rotary cutters of the cutter assembly.

Turning now to a discussion of the cutter assembly 60 which, as more clearly shown in the detail view of FIG. 7, has three rotary cutters 62. Each of the rotary cutters 62 is supported by a mounting plate 148 to which the motor 64 (see also FIG. 1) is attached. The motor 64 has an extending motor shaft (not shown) that passes through the mounting plate 148 and supports at a distal end thereof a drive block 150 that supports, in turn, a number of cutters 152. The motor 64 thus rotates the cutters 152 in a cutting engagement against the floor covering 30.

Each mounting plate 148 is linked to a cross member 154 by a pair of pivoting support arms 156, 158. The pivoting support arm 156 has a proximal end 160 supported by a pivot assembly 162. The pivot assembly 162 has a pair of pivot blocks 164, 166 attached to the cross member 154 in a parallel spatial relationship to provide a gap for receiving the proximal end 160 of the pivoting support arm 156. In like manner, the pivoting support arm 158 has a proximal end 168 supported by a pivot assembly 170. The pivot assembly 170 has a pair of pivot blocks 172, 174 attached to the cross member 154 in a parallel spatial relationship to provide a gap for receiving the proximal end 168 of the pivoting support arm 158.

The respective end of the arm 156 is pinned to the blocks 164, 166 and the respective end of the arm 158 is pinned to the blocks 172, 174.

Turning now to the distal end of the pivoting support arms 156, 158, in FIG. 7 a universal joint 182 is supported by the pivoting support arm 156. The universal joint 182 has a swiveling portion (not shown) attached to the mounting plate 148. The universal joint 182 can be a ball and socket joint, wherein the socket portion is captured by the pivoting support arm 156 and the ball portion is attached to the mounting plate 148. The opposing pivoting support arm 158 is joined to the mounting plate 148 in like manner by another universal joint 182. This permits a lateral movement, or in other words a rolling movement, of the mounting plate 148 as the pivoting support arms 156, 158 pivot relative to each other to a non-parallel relationship.

In this manner it will be understood the rotary cutters 62 are movable in accordance with the linked connection of the mounting plate 148 as provided by the pivoting support arms 156, 158. Each mounting plate 148 freely pivots upwardly and downwardly.

The mounting plate 148 is biased against flanges 188, 194 by a number of compression springs 195, one of which being shown in detail in FIG. 8. The downward biasing force can be adjusted by threadingly advancing a fastener 197 relative to the flanges 188, 194. Downward movement of the mounting plate 148 is limited by the horizontal flange 188 of the cross member 154 which abuttingly engages a proximal end 190 of the mounting plate 148. Similarly, an opposing cross member 192, shown partially cutaway in FIG. 7, has a horizontal flange 194 which abuttingly engages a distal end 196 of the mounting plate 148. In this manner, the range of movement of the mounting plate 148 is limited to a downward pivotal extent by the extending horizontal flanges 188, 194. This downward pivotal extent can be selectively determined by adjusting a pair of threaded members 198 that are threadingly engaged with the mounting plate 148 and threadingly advanceable to engage a distal end of the threaded member 198 against the flanges 188, 194 at the desired extent of downwardly pivoting movement of the mounting plate 148. The threaded member 198 can therefore be threadingly advanced to raise the downward extent of pivotal movement of the cutter assembly 60 above that otherwise provided by the engagement of the mounting plate 148 against the horizontal flanges 188, 194.

The embodiment of the present invention described hereinabove is easily modifiable by one of skill in the art to render contemplated, yet not explicitly disclosed embodiments. It would be possible, for example, to reduce manufacturing cost by replacing the universal joint 182 (see FIG. 7) at the distal ends of the pivoting support arms 156, 158 with a pivot such as that described in the proximal ends of the pivoting support arms 156, 158. Doing so would not defeat the independent suspension of the rotary cutters 62, but doing so would be at the expense of mostly all the lateral pivoting movement of the rotary cutters 62.

Figure 9:
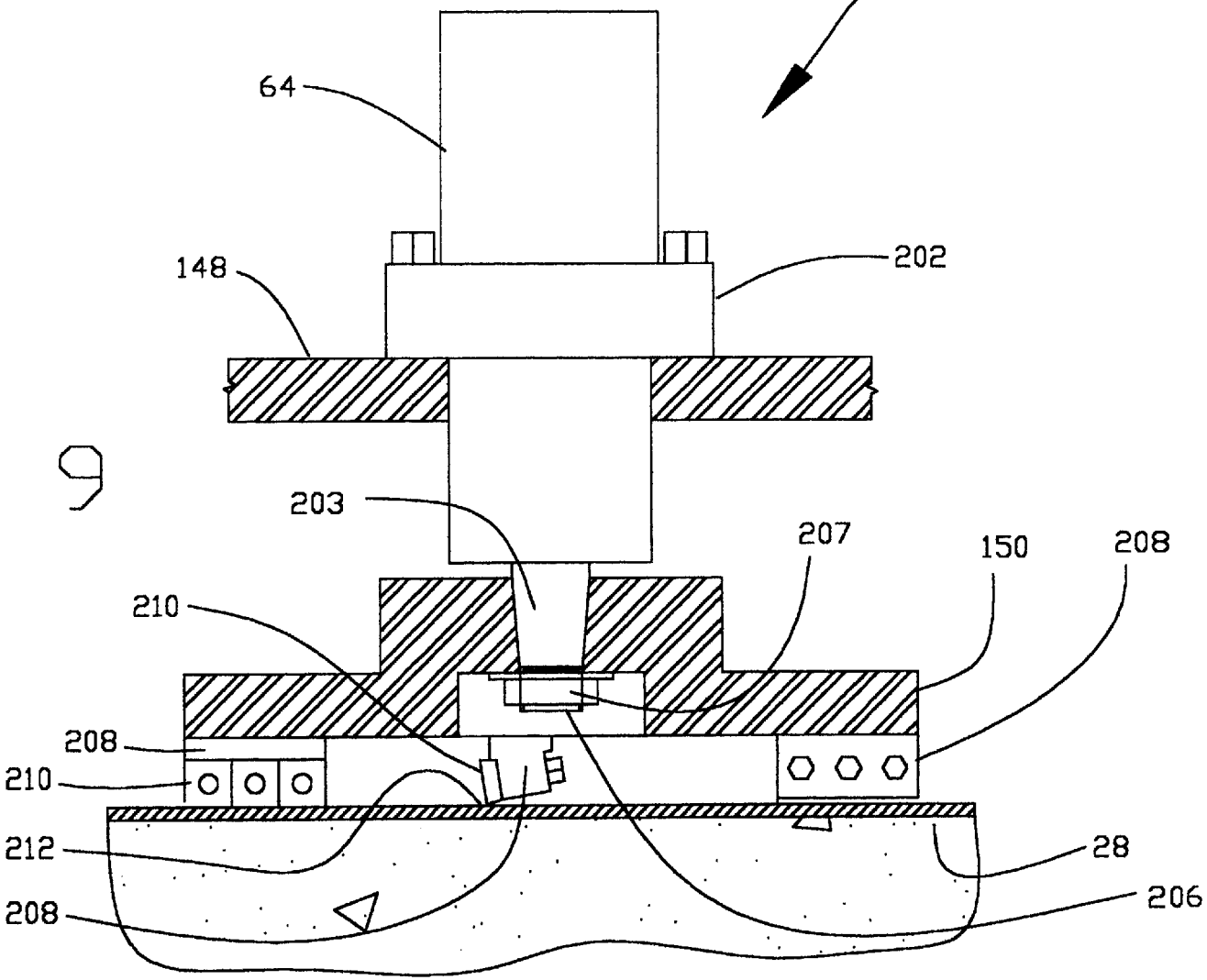
FIG. 9 is a cross-sectional view of a typical rotary cutter connected to a driving motor.

Turning now to focus on the rotary cutter 62 which is supported by the mounting plate 148, FIG. 9 is a partial cross-sectional view of the mounting plate 148 and of the rotary cutter 62. The rotary cutter 62 includes the motor 64 that has a base portion 202 attached to the mounting plate 148. A rotatable shaft 203 depends downwardly from the motor 64, the rotatable shaft 203 having a threaded portion 206 at a distal end thereof. The drive block 150 is attached to the rotatable shaft 203 by threading engagement of a fastener 207 with the threaded portion 206.

A plurality of cutter blocks 208 extend radially along the drive block 150. Each cutter block 208 supports a number of cutter inserts 210 having cutting edges 212 that are moved against the floor covering 30 by the rotation of the drive block 150 to cut away and remove the floor covering 30.

The cutter block 208 supports the cutter inserts 210 so as to impart a selected operative cutting angle between the cutting edges 212 and the floor covering 30. The preferred angle depends in part on the type of floor covering 30 being removed. Relatively soft materials, such as vinyl tile and adhesives, are better removed with a relatively shallow leading angle of the cutting edges 212 in order to provide a greater lifting force on the floor covering 30. Relatively hard materials, such as ceramic tile, however, are better removed with a relatively steep leading angle of the cutting edges 212 in order to provide a greater scraping force on the floor covering 30.

In operation, the weight of the rotary cutter 62 and the rotation of the drive block 150 force the cutting edges 212 downwardly through the floor covering 30 and against the floor surface 28 beneath. An optimal cutting and scraping action is achieved when all the cutting edges 212 of all the cutter inserts 210 are actively engaged in cutting and scraping away the floor covering 30. Process variations, however, can tend to force the rotary cutters 62 away, or partially away, from the floor surface 28, thereby making only partial contact of all the cutting edges 212 with the floor covering 30. An uneven floor condition, for example, can cause adjacent rotary cutters 62 to effectively work upon different cutting planes. Entrained debris built up under one rotary cutter 62, or debris run over by one of the wheel assemblies 24, can raise the supporting framework such as the central frame 12 and/or the cross member 154 away from the floor covering 30. In either case, the independent suspension provided by the pivoting support arms 156, 158 permits each rotary cutter 62 to positionally conform to the contour of the floor surface 28 independently of these or any other adverse influences tending to otherwise draw the rotary cutter 62 away from the floor covering 30.

With the mounting of the rotary cutters in the manner described above, each cutter 62 can follow the surface of the floor on which is working, independent of the other rotary cutters, such that the cutters will efficiently follow the varying contour of the floor being worked on.

Figure 10:
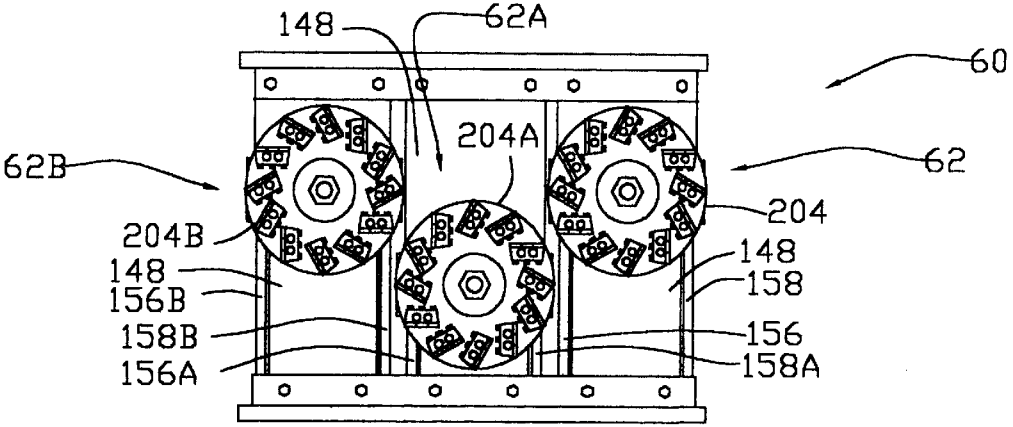
FIG. 10 is a plan view of the rotary cutters showing their arrangement.
Figure 11:
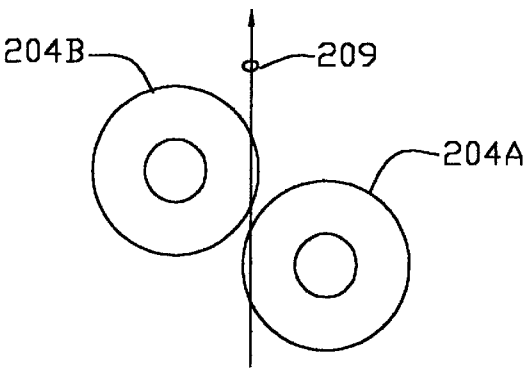
FIG. 11 is a schematic illustration illustrating the cutting paths of rotary cutters.

FIG. 10 is a top view of the three rotary cutters 62, 62A, 62B in the manner employed in the cutter assembly 60. An effective cutting diameter is denoted by a reference circle 204, 204A, 204B, respectively, representing the circular cutting area of the rotary cutters 62, 62A, 62B. By shortening the pivoting support arms 156A, 158A relative to the adjacent pivoting support arms 156, 158 and 156B, 158B, the adjacent rotary cutters 62, 62A, 62B can be laterally disposed in close proximity such that the cutting diameters 204, 204A, 204B overlap each other. This is better illustrated in the diagrammatical representation of FIG. 11 wherein it is clear that the cutting diameter 204A and the cutting diameter 204B both overlap a substantially tangential reference line 209 that represents a direction of movement that is parallel to the direction of movement of the floor treatment apparatus 10. In this manner, the overlapping cutting action of adjacent rotary cutters 62, 62A, 62B leaves no vestige of floor covering 30.

Turning back to FIG. 1, which shows the rotary cutter assembly 60 of FIG. 7 as it is installed beneath the medial portion 22 of the central frame 12. A forward bulkhead 214 is attached to the first lift arm 66 and to the second lift arm 78 (see FIG. 2), and is thereby movable with the first and second lift arms 66, 78 in pivotal movement about the pivots 68, 80. The forward bulkhead 214 supports a forward rail member 216 that supports, in turn, a swinging support member 217. The cross member 192 (reference FIG. 7), that limits the downward pivotal movement of the rotary cutters 62, is attached to the swinging support member 217. Similarly, a rear bulkhead 218 is attached to the first lift arm 66 and to the second lift arm 78, and is likewise movable with the first and second lift arms 66, 78 in pivotal movement of the first and second lift arms 66, 78 about the pivots 68, 80. The rear bulkhead 218 supports a rear rail member 220 that supports, in turn, a swinging support member 221. The cross member 154 (reference FIG. 7), that limits the downward pivotal movement of the rotary cutters 62, is attached to the swinging support member 221.

In the operative position of the rotary cutters 62, as shown in FIG. 1, the cutter inserts 210 are disposed adjacent the floor surface 28, making them inaccessible for maintenance or replacement work. It will be shown below how the swinging support members 217, 221 support the cross members 192, 154, respectively, so as to permit a lateral swinging movement of the cutter assembly 60 from the operative horizontal position to an inoperative vertical position whereby the cutter inserts 210 are readily accessible for maintenance or replacement.

Attention now is directed to the different modes of operation that are associated with the use of the floor treatment apparatus 10. As explained in the following, in the preferred mode the scraping tool assembly 56 alone is utilized, wherein the rotary cutter assembly 60 is automatically retracted by the use of the scraping tool assembly 56. In another mode the scraping tool assembly 56 is retracted to automatically engage the rotary cutter assembly 60.

FIG. 1 shows the latter mode wherein the floor treatment apparatus 10 has the scraping tool assembly 56 retracted and the rotary cutter assembly 60 engaged for a cutting removal of the floor covering 30. The scraping tool assembly 56 is retracted, so as to disengage the scraper blade 58 from the floor surface 28, by retracting the cylinders 98, 104. The weight of the several components biases the first and second lift arms 66, 78 downward into a pressing engagement against the positive stop members 76, 88. If needed, the lift cylinders 70, 82 can also be extended to bias the first and second lift arms 66, 78 downward against the positive stop members 76, 88. In this mode the rotary cutters 62 are individually supported and freely movable upwardly, as described above, wherein the downward extent of movement is selectively determined by adjusting the position of the adjusting screws 198.

Figure 12:
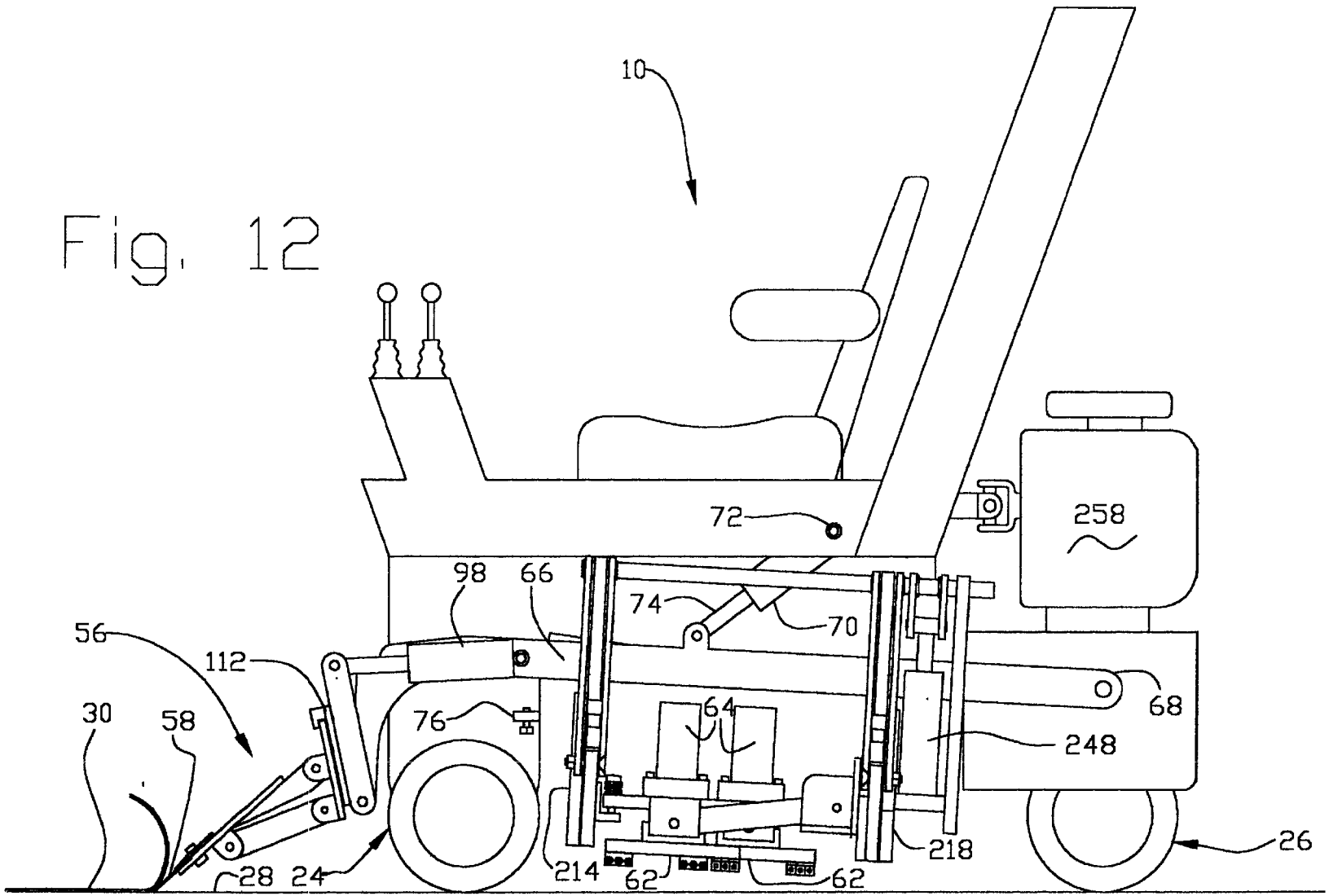
FIG. 12 is another elevational view looking at the left side of the apparatus illustrating the operating condition when the scraping blade is used and the rotary cutters are removed from the floor surface.

Contrarily, FIG. 12 illustrates the floor treatment apparatus 10 in the scraping mode, wherein the scraper blade 58 is lowered into a scraping engagement against the floor surface 28 for scrapingly engaging the floor covering 30. The scraper blade 58 is lowered by switching the lift cylinders 70, 82 to a floating mode which permits dampened movement of the extensible shaft 74, 86 relative to the base 72, 84 for a selectively dampened movement of the first and second lift arms 66, 78 relative to the central frame 12. The cylinders 98, 104 are then extended to tilt the tool mounting plate 112 forward so as to engage the scraper blade 58 against the floor surface 28.

The scraping action of the scraper blade 58 against the floor covering 30 requires a certain threshold loading of the scraper blade 58 against the floor surface 28. The threshold loading is defined as the minimum downward force on the scraper blade 58 necessary to keep the scraper blade 58 in a wedging engagement between the floor covering 30 and the floor surface 28 during a forward movement of the central frame 12 as it is propelled by the motorized wheel assemblies 24, 26. In other words, the downward threshold force prevents the scraper blade 58 from jumping upward onto the top surface of the floor covering 30 during use of the scraping tool assembly 56.

The downward force on the scraper blade 58, to achieve at least the threshold force downward on the scraper blade 58, creates an opposite reactive force that acts generally upwardly through the scraping tool assembly 56 and into the first and second lift-arms 66, 78. With the lift cylinders 70, 82 in the floating mode, the downward, at least threshold, force on the scraper blade 58 imparts an upward force that is sufficient to pivot the first and second lift arms 66, 78 upwardly about the pivots 68, 80. This upward movement of the first and second lift arms 66, 78 raises the forward bulkhead 214 and the rear bulkhead 218 so as to move the cutter assembly 60 upwardly to a cutting disengagement with the floor surface 28, or in other words to a retracted position of the cutter assembly 60.

In a floor covering removal operation of the floor treatment apparatus 10, it is preferred that the scraping tool assembly 56 be engaged in this manner for the economic benefit associated with the scraping action of the scraping tool assembly 56, as described hereinabove. There are occasions, however, when the scraping action of the scraping tool assembly 56 is not well-suited for removing the floor covering 30. Certain floor coverings 30, especially relatively thin floor coverings 30 such as a layer of mastic, are more efficiently removed by the cutting action of the rotary cutter assembly 60. Where a tile adhered with mastic is being removed from the floor surface 28, then it can be advantageous in accordance with the present invention to quickly switch back and forth between the scraping action of the scraping tool assembly 56 and the cutting action of the rotary cutter assembly 60. The automatic retraction of the rotary cutter assembly 60 by engagement of the scraping tool assembly 56 allows a quick and simple transition between the two modes, providing a combination of the two methods offering optimal efficiency and effectiveness in removing the floor covering 30.

In certain other cases the floor surface 28 cannot withstand the downward threshold force of the scraper blade 58. Relatively soft floors such as wood floors are readily gouged by the scraping action of the scraper blade 58 against the floor surface 28. Uneven floors, too, that have been previously leveled with floor compound are susceptible to damage because the scraper blade 58, which is biased downward against the floor surface 28, will follow the floor surface 28 contour and thus is likely to scrape away the floor leveling compound. These situations illustrate instances where use of the cutter assembly 60 is the preferred method of removing the floor covering 30.

In addition to removing floor covering 30, the cutter assembly 60 of the floor treatment apparatus 10 is also useful in planing a floor surface 28 to make it level. In one mode the cutter assembly 60 can be engaged by retracting the scraping tool assembly 56, as illustrated in FIG. 1. The downward extent of cutting depth of the rotary cutters 62 is set by the threaded member 198, as described above. In this mode, a floor surface 28 can be treated with leveling compound, and then leveled by passing the rotary cutter assembly 60 over the floor surface 28. A level surface will be provided as the cutter assembly 60 passes over the floor leveling compound disposed in low spots in the floor surface, and otherwise cuts away floor leveling compound that lies above the desired floor surface 28 plane.

Additionally, the cutter assembly 60 can be used to level a floor surface by cutting away high spots of the floor surface 28 itself. For some floor surface materials, such as concrete, a special purpose cutter may be necessary in order to cut the floor material. For concrete, shallow cuts can be made with the cutter inserts 210 described above. For deeper cuts, generally a diamond cutting wheel is preferred, which is supported by the drive block 150 of the rotary cutter 62 in place of the cutter inserts 210.

The floor treatment apparatus 10 thus provides the advantage of having both a scraping tool assembly 56 and a rotary cutter assembly 60 for removing floor covering 30 and/or planing the floor surface 28. The rotary cutter assembly 60, being disposed beneath the medial portion 22 of the central frame 12, makes it difficult to access the cutter inserts 210 mounted to the bottom side of the drive block 150. To solve this problem, the present invention furthermore provides a rotation assembly 222 (see FIGS. 13–18) to selectively rotate the cutter assembly 60 from a substantially horizontal position beneath the medial portion 22 of the central frame 12 to a substantially vertical position outboard of the central frame 12. This rotation of the cutter assembly 60 to an outboard vertical position thereby exposes the cutter inserts 210 to permit ready access for cutter inspection and replacement.

Figure 13:
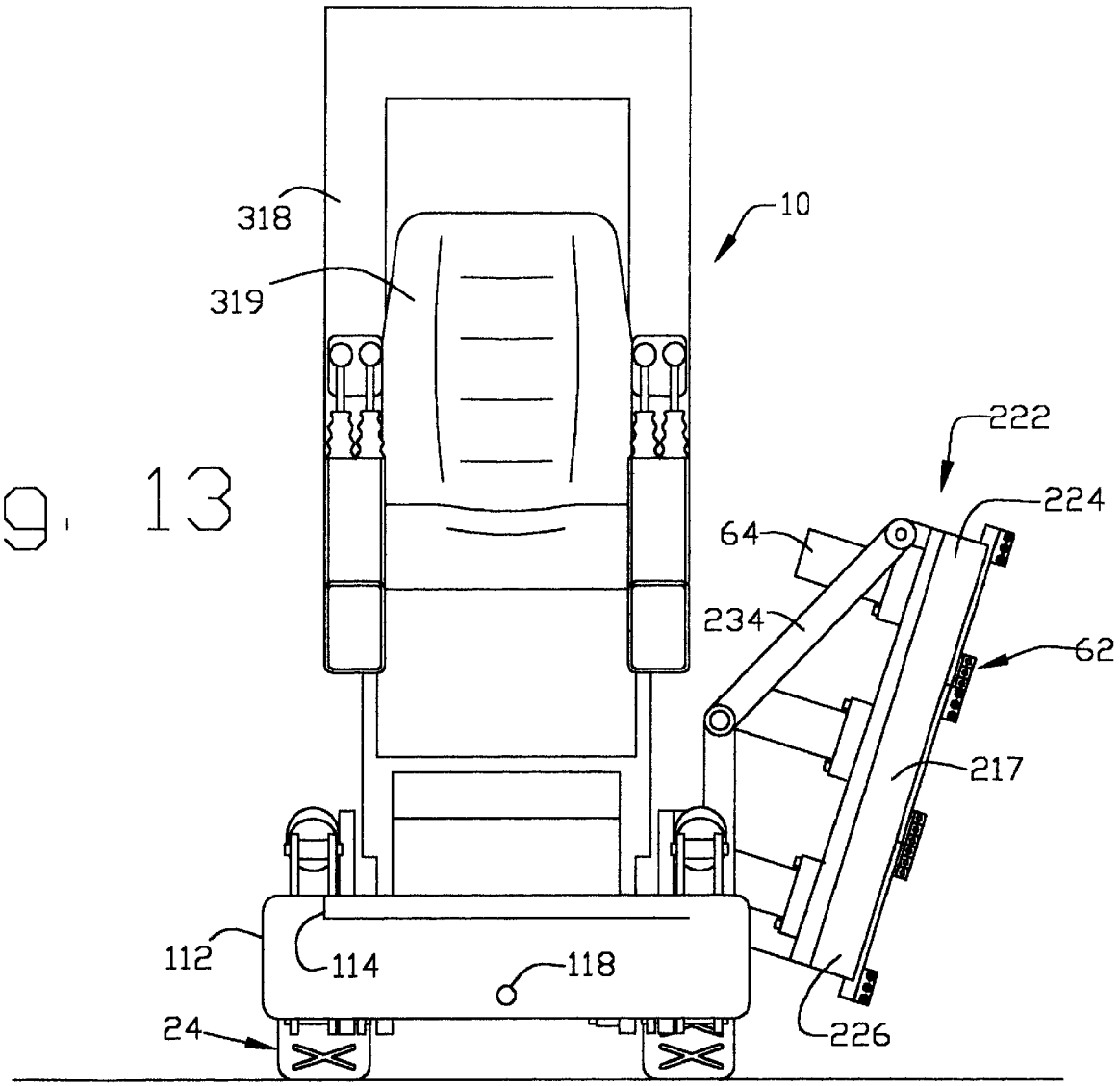
FIG. 13 is another elevational view looking at the front of the apparatus showing the rotary cutter assembly swung to the side of the apparatus for ready access to the rotary cutters.
Figure 14:
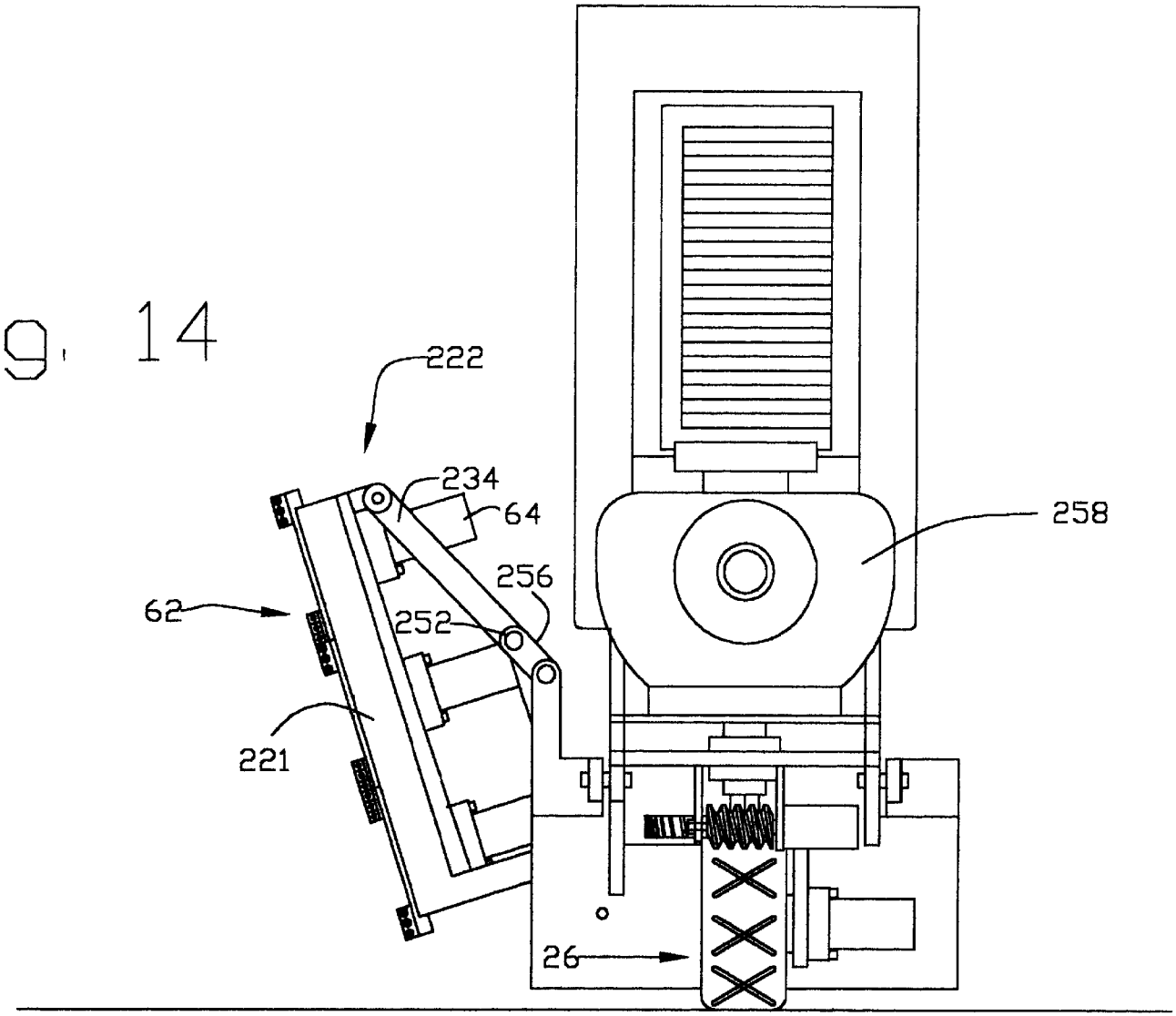
FIG. 14 is an elevational view looking at the rear of the apparatus also showing the cutter assembly at the side of the apparatus for ready access to the rotary cutters.
Figure 15:
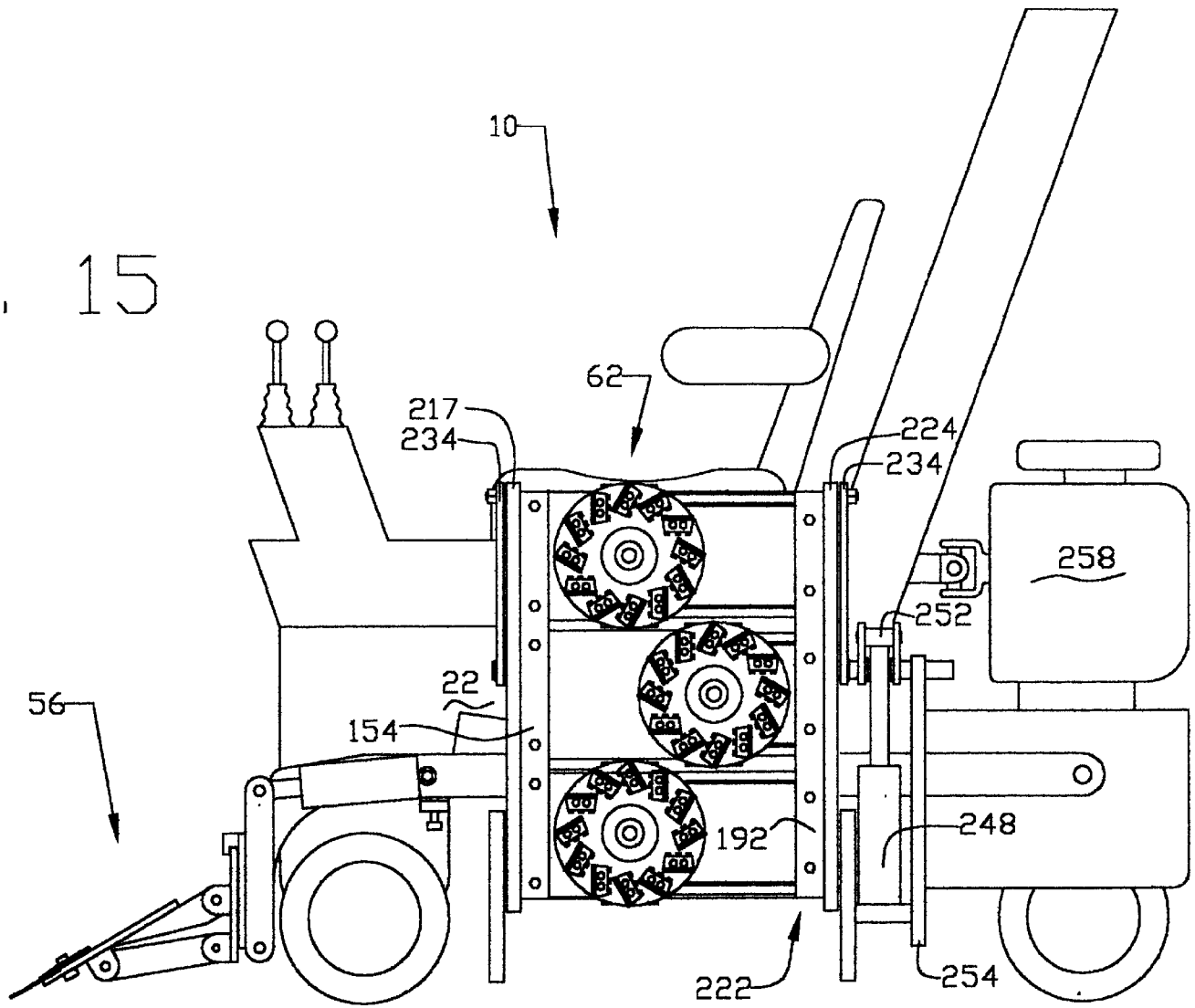
FIG. 15 is an elevational view looking at the left side of the apparatus with the rotary cutter assembly raised to the side of the machine similar to FIGS. 13 and 14.

FIGS. 13, 14, and 15 are views of the floor treatment apparatus 10 with the rotary cutter assembly 60 in the inoperative, vertical position to provide ready access to the plurality of cutter inserts 210. The cross member 192 (reference FIG. 7) is swung outwardly by the swinging support member 217 (FIG. 13) and the cross member 154 (reference FIG. 7) is swung outwardly by the swinging support member 221 (FIG. 14). The swinging support member 217 has a first end 224 and a longitudinally distal second end 226. Both the first end 224 and the second end 226 of the swinging support member 217 are supported by the forward rail 216 (FIGS. 16, 17, and 18) that is attached to the forward bulkhead 214. The supporting forward rail 216 has an upstanding supporting portion 228 with an aperture 230 disposed therein for receiving engagement of a shaft 232. A pair of extending link arms 234 have first ends 236 disposed about the first end 224 of the support member 217 and are pinned thereto by a pivot 238. The extending link arms 234 furthermore have second ends 240 disposed about the upstanding portion 228 of the supporting forward rail 216 and attached to the shaft 232. In this manner, rotation of the shaft 232 imparts pivotal movement of the extending link arms 234 so as to, in turn, rotate the first end 224 of the swinging support member 217 from a substantially horizontal position beneath the medial portion 22 of the central frame 12 to a substantially vertical position outboard of the central frame 12.

Figure 16:
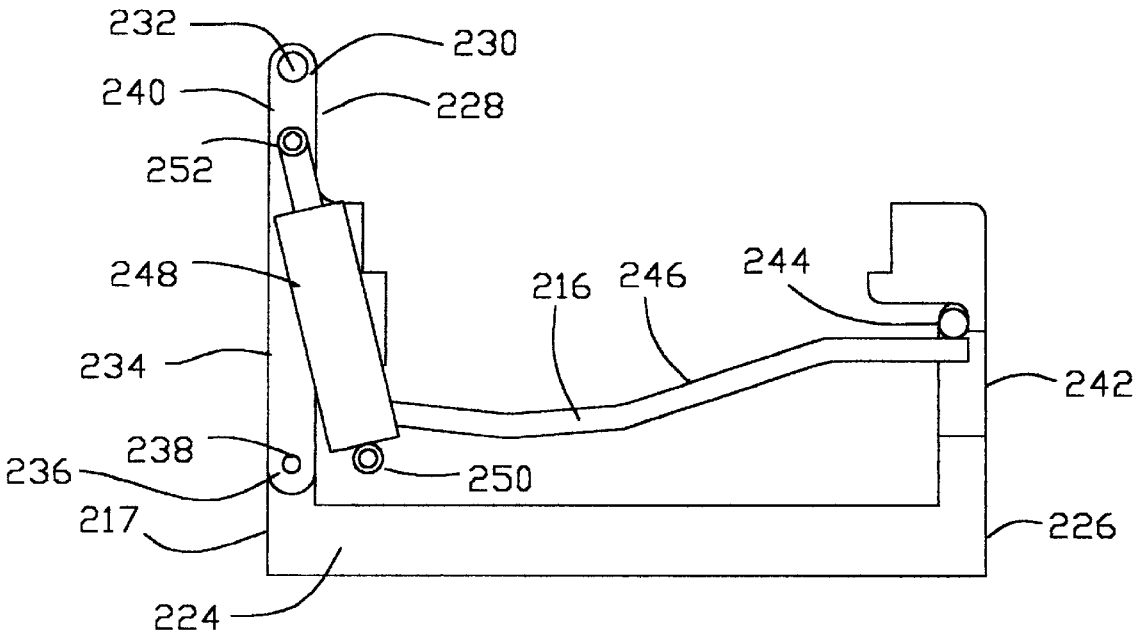
FIG. 16 is an illustration of the mechanism for swinging the cutter assembly from underneath the apparatus to one side of the apparatus, with the structure shown in the position when the rotary cutter assembly is below the apparatus. The structure shown in FIG. 16 is used at both the front and at the rear of the cutter assembly.
Figure 17:
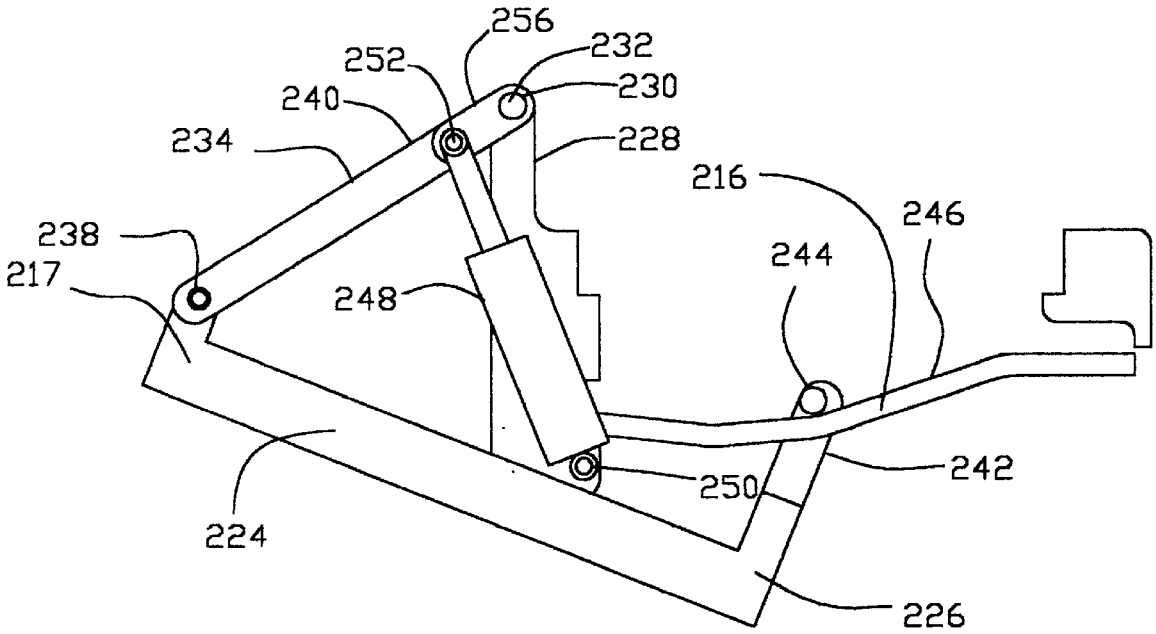
FIG. 17 is an illustration of the structure shown in FIG. 16 in the position of the structure when cutter assembly is moved partway from underneath the apparatus to the side of the apparatus.
Figure 18:
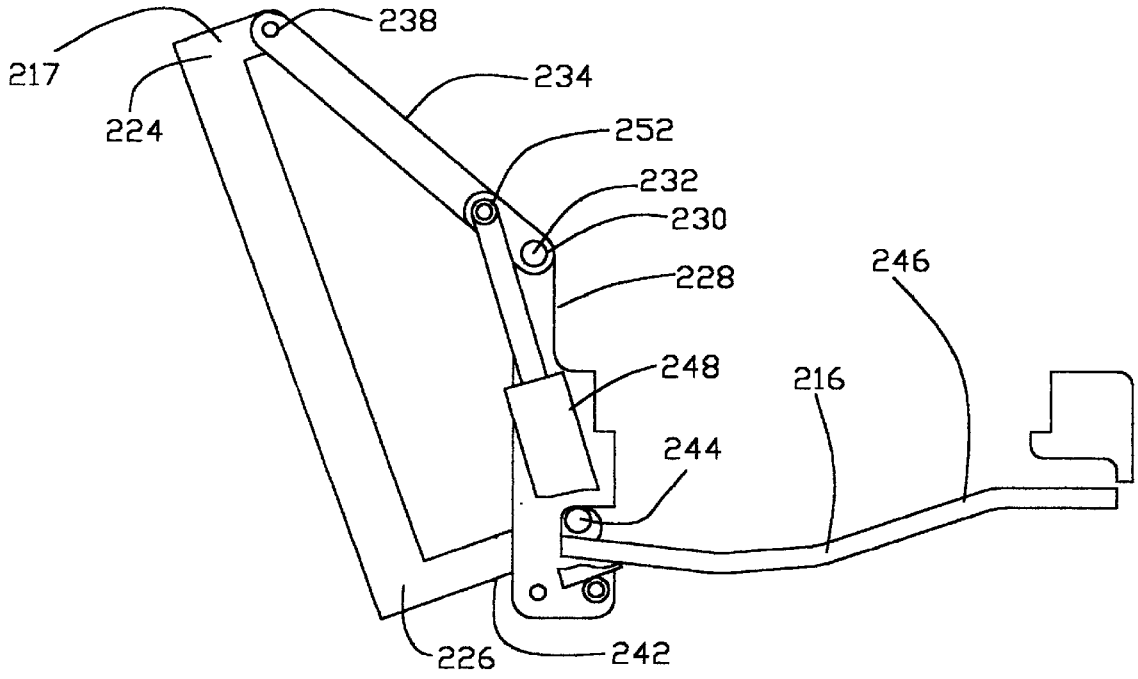
FIG. 18 is an illustration of the apparatus of FIG. 16 showing the position of the structure when the cutter assembly is raised to the left side of the apparatus.

As the first end 224 of the swinging support member 217 is swung outwardly to the vertical position, ultimately to that shown in FIGS. 13–15 and 18, the second end 226 of the swinging support member 217 is cammingly supported by the supporting forward rail 216. FIGS. 16–18 are elevational views showing the manner in which the supporting forward rail 216 supports the swinging support member 217. The first end 224 of the swinging support member 217 is pinned by the pivot 238 to the extending link arms 234 as previously discussed. The swinging support member 217 supports a linkage 242 with a cam roller 244 at a distal end thereof and rollingly engages an upper surface 246 of the supporting forward rail 216.

A cylinder 248 has a fixed end 250 attached to the central frame 12 (not shown) and an extensible end 252 connected by way of a yoke linkage (not shown in FIGS. 16–18) to the extending link arms 234 so as to rotate the extending link arms 234 in response to extending the cylinder 248. FIG. 16 illustrates the swinging support member 217 in a retracted position, which corresponds to the cutter assembly 60 (not shown) being positioned in an operative, horizontal, position beneath the medial portion 22 of the central frame 12. FIG. 17 illustrates the swinging support member 217 rotated about half-way between the retracted position of FIG. 16 and a fully extended, vertical, position. The cylinder 248 is partially extended to rotate the extending link arms 234 so as to raise the first end 224 of the swinging support member 217 by the pinned connection of the pivot 238. The second end 226 of the swinging support member 217 follows as it is supported by the cam roller 244 cammingly engaging the upper surface 246 of the supporting forward rail 216. Finally, FIG. 18 illustrates the swinging support member 217 in the fully extended, vertical, position whereby the supported cutter assembly 60 (not shown) is in a substantially vertical position like that shown in FIGS. 13–15. Note that the cylinder 248, now in a fully extended position, is shown partially cutaway (in FIG. 18) to show the position of the cam roller 244 supporting the second end 226 of the swinging support member 217 in the extended position of the swinging support member 217.

The swinging support member 221 is supported by a rear rail 220 and associated structure in the same manner as the forward swinging support member 217.

Returning to FIG. 1, it will be noted the cylinder 248 is supported at the fixed end 250 thereof by the rear bulkhead 218 and by a support 254 which depends from the first lift arm 66. The support 254 has an aperture in alignment with the apertures 230 of the upstanding supporting portions 228 of the forward and rear rails 216, 220 to receivingly engage the shaft 232 and to support free rotation of the shaft 232 therein. The extensible end 252 of the cylinder 248 is attached to a yoke 256 which is attached for a fixed rotation with the shaft 232. The extending link arms 234 are likewise attached for a fixed rotation with the shaft 232. In this manner, therefore, extension of the cylinder 248 rotates the yoke 256 to rotate the shaft 232 which, in turn, rotates the extending link arms 234 to move the swinging support members 217, 221 to an outboard position.

Turning now to a description of the power plant, drive train and controls for the floor treatment apparatus 10, FIGS. 2 and 4 show an internal combustion engine 258 that is mounted to a motor mounting plate 260 supported, in turn, by the cross member 42 of the central frame 12. The internal combustion engine 258 has an output drive shaft 262 that drives a number of pumps (not shown) to power the various components of the floor treatment apparatus 10 described above. Included in the output drive shaft 262 between the internal combustion engine 258 and the pumps is a universal joint mechanism 264 for isolating vibration of the internal combustion engine 258. In some instances, namely indoor jobs, an electric motor may be required in place of the internal combustion engine 258. The universal joint mechanism 264 can be disconnected to remove the internal combustion engine 258 and replace it with an electric motor (not shown) having a like universal joint connection or an output shaft thereof.

Figure 19:
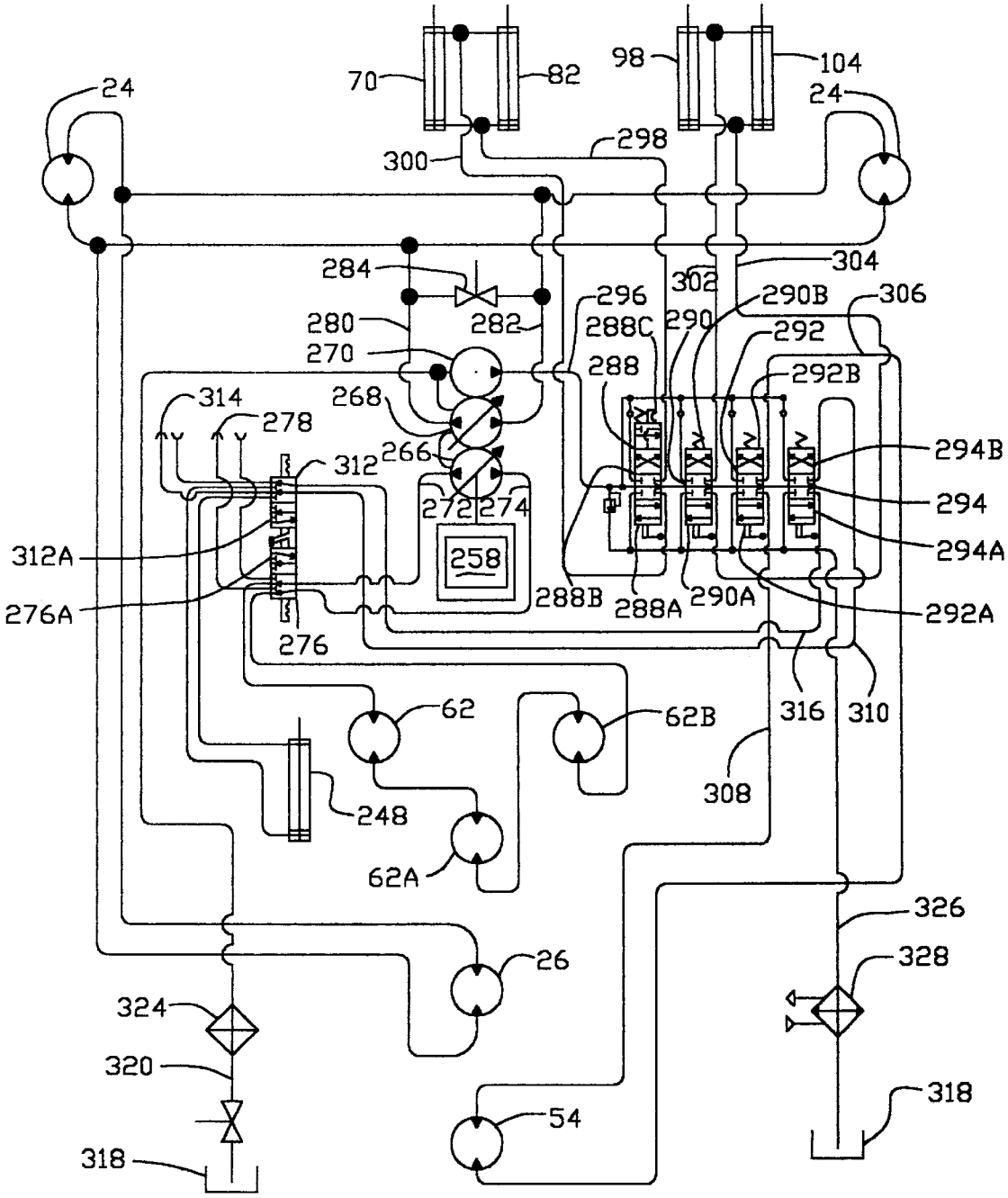
FIG. 19 is a schematic illustration of the hydraulic controls for operation of the apparatus.

FIG. 19 is a schematic view of a hydraulic system constructed in accordance with the present invention and therefore suited for use in the floor treatment apparatus 10 described hereinabove, wherein the internal combustion engine 258 (or alternatively an electric motor) drives in series a number of pumps 266, 268, 270. Pump 266 is an over-center, variable displacement type pump which allows the user to control the pump 266 so as to direct a pressurized stream of fluid along an outlet line 272 or along an outlet line 274. A diverter valve 276 is positionable between a first position, as shown in FIG. 19, to fluidly connect the pump 266 with the rotary cutters 62, 62A, 62B of the cutter assembly 60, and a second position to fluidly connect the pump 266 with an auxiliary power supply connection 278. In the first position of the diverter valve 276, reversing the pump element of the pump 266 between the outlet line 272 and the outlet line 274 resultingly reverses the direction of rotation of the rotary cutters 62, 62A, 62B. In the second position of the diverter valve 276, the auxiliary power supply connection 278 can be connected to power tool accessories used in conjunction with the floor treatment apparatus 10 such as, but not limited to, a powered jack hammer attachment (not shown).

The pump 268, like pump 266, is an over-center, variable displacement pump which allows a user to control the pump 268 so as to direct a pressurized stream of fluid along outlet line 280 or alternatively along outlet line 282. A valve 284 is disposed in parallel with the pump 268 providing a short-circuit when opened. With the valve 284 sufficiently closed, the pump 268 delivers pressurized fluid to the motorized wheel assemblies 24 at the front end portion 18 of the central frame 12, and to the motorized wheel assembly 26 at the rear end portion 20 of the central frame 12. Reversing the direction of the pumping element of the pump 268 resultingly reverses the direction of the motorized wheel assemblies 24, 26, so as to effect the movement of the central frame 12 in a reverse direction. For a given setting of the pumping element of the pump 268, the valve 284 can be selectively opened to provide a neutral running position of the floor treatment apparatus 10.

The pump 270 is a fixed displacement pump that provides pressurized hydraulic fluid to a bank of control valves 288, 290, 292, 294 by way of an outlet line 296. The control valve 288 has a blocked position as shown in FIG. 19. The control valve 288 has a second position 288A that directs the pressurized hydraulic fluid to line 298 to raise the lift cylinders 70, 82 (see FIGS. 1 and 2). The control valve 288 has a third position 288B that directs the pressurized fluid from outlet line 296 to line 300 to lower the lift cylinders 70, 82. The control valve 288 has a fourth position 288C that places the lift cylinders 70, 82 in the floating mode.

The control valve 290 has a blocked position as shown in FIG. 19. The control valve 290 has a second position 290A that directs the pressurized hydraulic fluid from the outlet line 296 to a line 302 to extend the cylinders 98, 104 so as to tilt the tool mounting plate 112 (see FIG. 12) forward. The control valve 290 has a third position 290B that directs the pressurized hydraulic fluid from the outlet line 296 to a line 304 to retract the cylinders 98, 104 so as to raise the tool mounting plate 112.

The control valve 292 has a blocked position as shown in FIG. 19. The control valve 292 has a second position 292A that directs the pressurized hydraulic fluid from the outlet line 296 to a line 306 to turn the steering motor 54 (see FIG. 4) so as to steer the central frame 12 of the floor treatment apparatus 10 in one direction. The control valve 292 has a third position 292B that directs the pressurized hydraulic fluid from the outlet line 296 to a line 308 to turn the steering motor 54 so as to turn the central frame 12 of the floor treatment apparatus 10 in the other direction.

The control valve 294 has a blocked position as shown in FIG. 19. The control valve 294 has a second position 294A that directs the pressurized hydraulic fluid from the outlet line 296 to a line 310 connected to a diverting valve 312. The diverting valve 312 has a first position shown in FIG. 19 that connects the line 310 to an auxiliary power supply 314. The diverting valve 312 has a second position 312A that connects the line 310 to the cylinder 248 (see. FIG. 1) for extending the cutter assembly 60 to the vertical position (see FIGS. 13–15). With the diverting valve 312 in the second position 312A, the control valve 294 has a third position 294B that directs the pressurized hydraulic fluid from the outlet line 296 to a line 316 connected to the cylinder 248 for retracting the cylinder 248 so as to move the cutter assembly 60 to the operative position beneath the medial portion 22 of the central frame 12.

Finally, FIG. 19 shows a hydraulic fluid reservoir 318 with a fluid supply line 320 feeding the pumps 266, 268, 270. FIG. 1 illustrates the use of hollow square tubing joined to form a protective roll bar about a seat 319, the square tubing being joined and sealed to provide a fluid reservoir 318 for storage of hydraulic fluid. A strainer 324 (FIG. 19) is provided in the fluid supply line 320. A fluid return line 326 passes through a forced-air oil cooler 328 (see FIGS. 4 and 19) before returning to the hydraulic fluid reservoir 318.

It is clear, then, that the present invention is well adapted to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within that which the inventor considers to be the subject matter of the present invention as is disclosed.

What is claimed is:

1. A machine for removing the covering from a floor, comprising:

a frame having a left side, a right side, a front end and a rear end;

wheels supporting the frame for movement across the floor;

a floor covering scraping blade mounted on the front end of the frame; and a rotary cutter assembly mounted under the frame between the front and rear ends of the frame for removing covering material from the floor;

wherein the mounting for the rotary cutter assembly supports the rotary cutter assembly under the frame and, alternately, to an elevated position at one side of the frame.

2. A machine defined in claim 1 characterized further to include means for lowering the scraping blade into engagement with the floor and raising the rotary cutter assembly above the floor, and vice versa.

3. A machine a defined in claim 1 wherein the rotary cutter assembly comprises a plurality of rotary cutters;

a plate supporting each rotary cutter; and means for limiting the downward movement of each last-mentioned plate to limit the depth of cut of each rotary cutter with respect to the frame.

4. A machine for removing the covering from a floor, comprising:

a frame having a left side, a right side, a front end and a rear end;

wheels supporting the frame for movement across the floor;

a floor covering scraping blade mounted on the front end of the frame; and a rotary cutter assembly mounted under the frame between the front and rear ends of the frame for removing covering material from the floor;

wherein the mounting for the rotary cutter assembly supports the rotary cutter assembly under the frame and, alternately, to one side of the frame; and wherein the scraping blade extends transversely across the front of the frame; and wherein the mounting for the scraping blade comprises;

a lift arm on each side of the frame having a forward end and a rear end and having its rear end pivotally secured to the frame for vertical swinging movement of the lift arms;

a tool mounting plate extending across the front of the frame and pivotally secured to each lift arm;

clamps securing the blade to the mounting plate; and hydraulic cylinders connected between the mounting plate and the lift arms, whereby the blade may be raised and lowered with respect to the lift arms.

5. A machine as defined in claim 4 wherein the rotary cutter assembly is attached to said lift arms.

6. A machine as defined in claim 5 characterized further to include a hydraulic cylinder connecting each rotary cutter assembly lift arm to the frame, whereby when the last mentioned cylinders are neutral, actuation of the hydraulic cylinder associated with the scraping blade when the scraping blade is in the contact with the floor will raise the rotary cutter assembly off of the floor, and when the hydraulic cylinders connecting the lift arms of the rotary cutter assembly are extended to lower the rotary cutter assembly against the floor, the hydraulic cylinders connected to the mounting plate may be retracted to raise the scraping blade from the floor.

7. A machine as defined in claim 4 characterized further to include a base plate clamped to said mounting plate and means attaching the scraper blade to said base plate, whereby the scraper blade is free to pivot with one end raising while the other end is lowering to follow the floor in the event the frame is tilted right or left during operation.

8. A machine for removing the covering from a floor, comprising;

a frame having a left side, a right side, a front end and a rear end;

wheels supporting the frame for movement across the floor;

a floor covering scraping blade mounted on the front end of the frame; and means for mounting the scraper blade whereby the scraper blade may tilt transversely with respect to the frame to follow the floor in the event the frame tilts left or right during operation;

wherein said means comprises a generally vertically extending base plate secured across the front of the frame;

a blade holder supporting the scraping blade and extending across the front of the frame;

an upper extension member secured at one end to the central portion of the blade holder by a ball joint connection and to the central portion of the base plate by a pivotal connection;

and a lower extension member pivotally attached to the blade holder adjacent each end of the base plate, and, at its opposite end, by a ball joint connection to the respective end portion of the scraping blade.

9. A machine for removing the covering from a floor, comprising;

a frame having a left side, a right side, a front end and a rear end;

wheels supporting the frame for movement across the floor;

a rotary cutter assembly mounted under the frame between the front and rear ends of the frame for removing covering material from the floor; and means for moving the rotary cutter assembly from a position under the frame to a position at one side of the frame for ready access to the rotary cutter assembly;

wherein the rotary cutter assembly comprises a plurality of rotary cutters;

a plate supporting each rotary cutter; and means for limiting the downward movement of each last-mentioned plate to limit the depth of cut of each rotary cutter with respect to the frame.

10. A machine as defined in claim 9 wherein the rotary cutter assembly comprises a plurality of rotary cutters arranged transversely with respect to the frame and supported to provide overlapping cuts.

11. A machine as defined in claim 9 wherein the rotary cutter assembly comprises a plurality of rotary cutters; and means for supporting each rotary cutter for independent tilting movement to follow the varying contour of said floor.

* * * * *